US006493975B1

(12) United States Patent
Cobb et al.

(10) Patent No.: US 6,493,975 B1
(45) Date of Patent: Dec. 17, 2002

(54) SIGN PANEL WITH REPLACEABLE, FRAMELESS-APPEARING SIGN FACE

(75) Inventors: Ronald W. Cobb, Atlanta, GA (US); Benjamin H. Bell, Avondale Estates, GA (US)

(73) Assignee: APCO Graphics, Inc., Atlanta, GA (US)

( * ) Notice: Subject to any disclaimer, the term of this patent is extended or adjusted under 35 U.S.C. 154(b) by 11 days.

(21) Appl. No.: 09/893,482

(22) Filed: Jun. 29, 2001

(51) Int. Cl.[7] ..... G09F 15/00
(52) U.S. Cl. ..... 40/611; 52/489.2; 40/607
(58) Field of Search ..... 40/606, 607, 611; 52/489.1, 489.2, 762, 773, 775

(56) References Cited

U.S. PATENT DOCUMENTS 3,965,599 A 6/1976 Ebner
3,987,567 A 10/1976 Fritts
4,123,885 A * 11/1978 Scott ..... 52/489.1
4,276,706 A * 7/1981 Scott ..... 40/607
4,408,407 A * 10/1983 Bloom et al. ..... 40/607
4,801,115 A 1/1989 Heard
4,802,296 A 2/1989 Kovalak, Jr.
5,158,346 A * 10/1992 Marks et al. ..... 312/204

* cited by examiner

*Primary Examiner*—S. Joseph Morano
*Assistant Examiner*—Frantz F. Jules
(74) *Attorney, Agent, or Firm*—Chambliss, Banner & Stophel, P.C.

(57) ABSTRACT

A sign assembly having a frameless-appearing sign face may be removed from and replaced into the assembly. The sign assembly includes a sign face having an outer surface, an inner surface and a peripheral side. The assembly also includes a sign frame having a sign face channel that is adapted to receive a portion of the sign face adjacent to the peripheral side. The sign face channel is defined by an inner frame portion and an outer frame portion. The assembly also includes a mounting component having a face support that is attached to the inner surface of the sign face adjacent to the peripheral side of the sign face, an inner support that is adapted to bear against the inner frame portion of the sign frame, and an outer support that is adapted to bear against the outer frame portion of the sign frame. The invention also includes a method for mounting a sign face on a mounting component and a method for converting a framed assembly into a frameless-appearing assembly.

18 Claims, 4 Drawing Sheets

SIGN PANEL WITH REPLACEABLE, FRAMELESS-APPEARING SIGN FACE

FIELD OF THE INVENTION

This invention relates generally to sign assemblies having removable and replaceable sign faces. More particularly, the invention relates to a sign assembly having one or more sign faces that are removably attached to a supporting frame in such a way as to appear to be frameless.

BACKGROUND AND DESCRIPTION OF THE PRIOR ART

Many sign assemblies include a sign panel or face which may be removed from the supporting frame of the assembly. Typically, such sign assemblies include a sign face that is attached to and supported by frame components or supports in such manner that the sign face has a framed appearance. Sign assemblies having a framed appearance are described in U.S. Pat. No. 4,408,407 of Bloom et al., U.S. Pat. No. 4,801,115 of Heard and U.S. Pat. No. 4,802,296 of Kovalak, Jr. Other sign assemblies include a sign face that is attached to and supported by a frame or sign support in such manner that the sign face has a frameless appearance. U.S. Pat. No. 4,276,706 of Scott describes such a sign assembly. Frameless appearing sign faces display the entire surface of the sign face, whereas sign faces having a framed appearance typically do not display a peripheral portion of the sign face.

Many sign assemblies are also adapted to accommodate removable sign faces, so that a sign face may easily be replaced. Typically, the face of a sign assembly having a framed appearance is removed for replacement by removing the supporting frame from the posts or wall on which it is mounted and disassembling at least a portion of the frame. Frameless appearing sign faces are usually mounted on the supporting frame using threaded fasteners or an adhesive. Other frameless appearing sign faces may be mounted on a supporting frame using mounting components that are difficult to remove in order to replace the sign face.

It would be desirable if a sign assembly could be provided having a frameless-appearing sign face that is supported by a frame in such manner that the sign face may be easily removed from the sign frame for replacement. It would also be desirable if such a sign assembly could be adapted to convert a conventional sign assembly having a sign face with a framed appearance into a frameless-appearing sign assembly.

ADVANTAGES OF THE INVENTION

Accordingly, it is an advantage of the invention claimed herein to provide a sign assembly having a frameless-appearing sign face which is removably attached to the sign frame. It is another advantage of the invention to provide such a sign assembly which permits a sign face to be easily removed and replaced. It is still another advantage of the invention to provide a sign assembly which may be comprised of few components a are easily manufactured and assembled. It is yet another advantage of the invention to provide a sign assembly that may be employed to convert a conventional sign assembly having a sign face with a framed appearance into a one with a frameless-appearance.

Additional advantages of this invention will become apparent from an examination of the drawings and the ensuing description.

EXPLANATION OF TECHNICAL TERMS

As used herein, the term sign face refers to a generally planar component on which information may be displayed.

As used herein, the term sign frame refers to a component or assembly that is adapted to support a sign face.

As used herein, the term signal post refers to a component or assembly to which a sign frame may be mounted.

As used herein, the terms frameless-appearing sign face, frameless appearance of a sign face and similar terms refer to a condition wherein a sign face is supported by a flame, no part of which extends beyond the periphery of the sign face. The sign frame may be mounted on one or more posts or on a wall or other surface.

As used herein, the term sign face having a framed appearance and similar terms refer to a condition wherein a sign face is supported by a frame, at least a part of which extends beyond the periphery of the sign face. The sign frame may be mounted on one or more posts or on a wall or other surface.

SUMMARY OF THE INVENTION

The invention comprises a sign assembly having a frameless-appearing sign face that may be removed from and replaced into the frame of the assembly. According to the invention, the sign assembly includes a sign face having an outer surface, an inner surface and a peripheral side. The assembly also includes a sign frame having a sign face channel that is adapted to receive a portion of the sign face adjacent to the peripheral side. The sign face channel is defined by an inner frame portion and an outer frame portion. The assembly also includes a mounting component having a face support that is attached to the inner surface of the sign face adjacent to a peripheral side of such sign face, an inner support that is adapted to bear against the inner frame portion of the sign frame, and an outer support that is adapted to bear against the outer frame portion of the sign frame. In addition, the face support of the mounting component is preferably generally coplanar with the outer frame portion of the sign frame.

The invention also comprises a method for mounting a sign face on a mounting component. According to the method, the mounting component of the assembly is placed on a frame assembly which includes a sign frame so that the inner support bears against the inner frame portion, the outer support bears against the outer frame portion, and the face support is generally coplanar with the outer frame portion. The sign face is then attached to the face support of the mounting component, preferably by use of an adhesive.

The invention also includes a method for converting a conventional channel frame sign system from a system having a visible frame around the sign face into a frameless-appearing sign system. According to this method, a mounting component having a face support an inner support that is adapted to bear against the inner frame portion of the sign frame, and an outer support that is adapted to bear against the outer frame portion of the sign frame is attached to an inner surface of a sign face. The mounting component is inserted into the sign face channel so that the inner support bears against the manner frame portion and the outer support bears against the outer frame portion of the sign frame while at least a portion of the inner surface of the sign face adjacent to the mounting component bears against a portion of the outside surface of the outer frame portion.

In order to facilitate an understanding of the invention, the preferred embodiments are illustrated in the drawings, and la detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
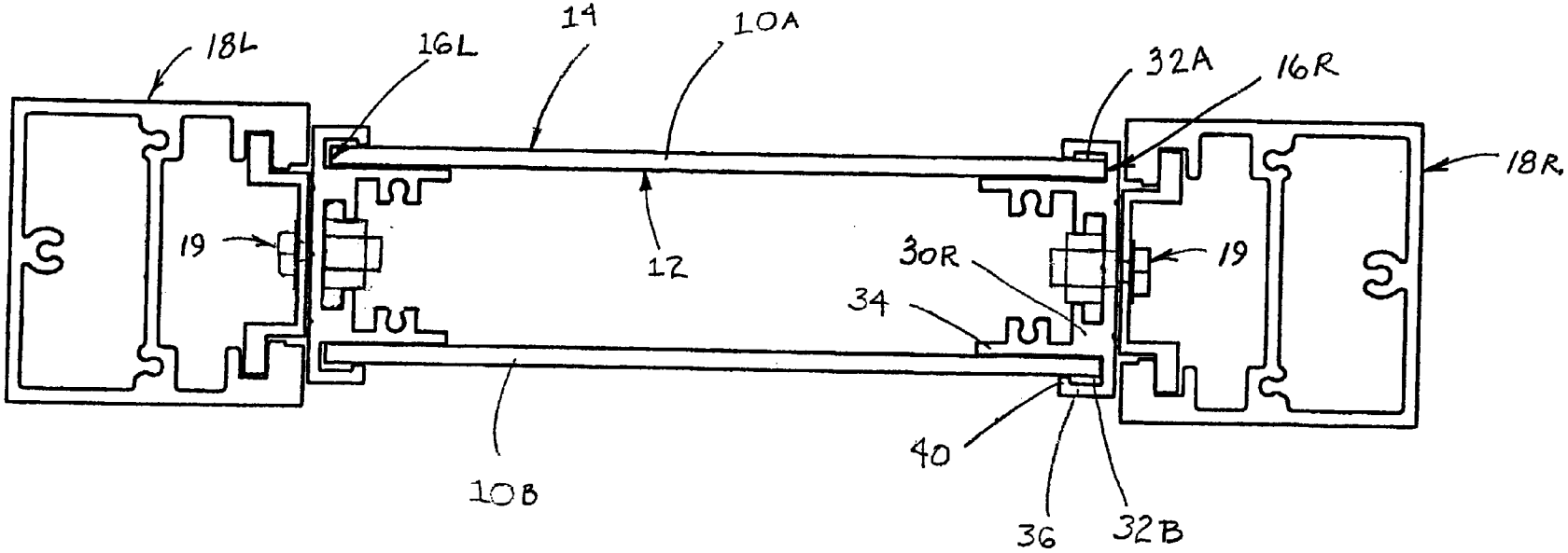
FIGURE 1 PRIOR ART
FIG. 1 is a top view of a conventional prior art sign system having sign faces which are slidably removable in channel frames.

Referring now to the drawings, FIG. 1 illustrates a conventional sign assembly which is adapted to support sign faces 10A and 10B in a manner so as to provide a framed appearance. Sign frames 30L and 30R are conventional channel frame extrusions which are adapted to provide rigid support to sign faces 10A and 10B. Each sign frame 30L and 30R includes a pair of sign face channels 32A and 32B, each of which is adapted to receive a portion of a sign face adjacent to a peripheral side. The sign frames are disposed opposite each other so that opposed channels of opposed sign frames may each receive a portion of a sign face adjacent to opposite peripheral sides. Thus, sign face channels 32A of sign frames 30L and 30R receive portions of sign face 10A adjacent to peripheral sides 16L and 16R respectively. Each sign face channel is defined by inner frame portion 34 and outer frame portion 36 having outer surface 38 and inwardly-turned outer frame portion 40. Furthermore, the sign face channels of each sign frame are spaced to support a pair of sign faces 10A and 10B in a generally parallel relationship. The conventional sign frames are mounted on sign posts 18L and 18R by means of threaded fasteners 19. In the alternative, the sign frames may be conventionally mounted onto sign posts by welding or by other methods known to those having ordinary skill in the art to which the invention relates.

Figure 2:
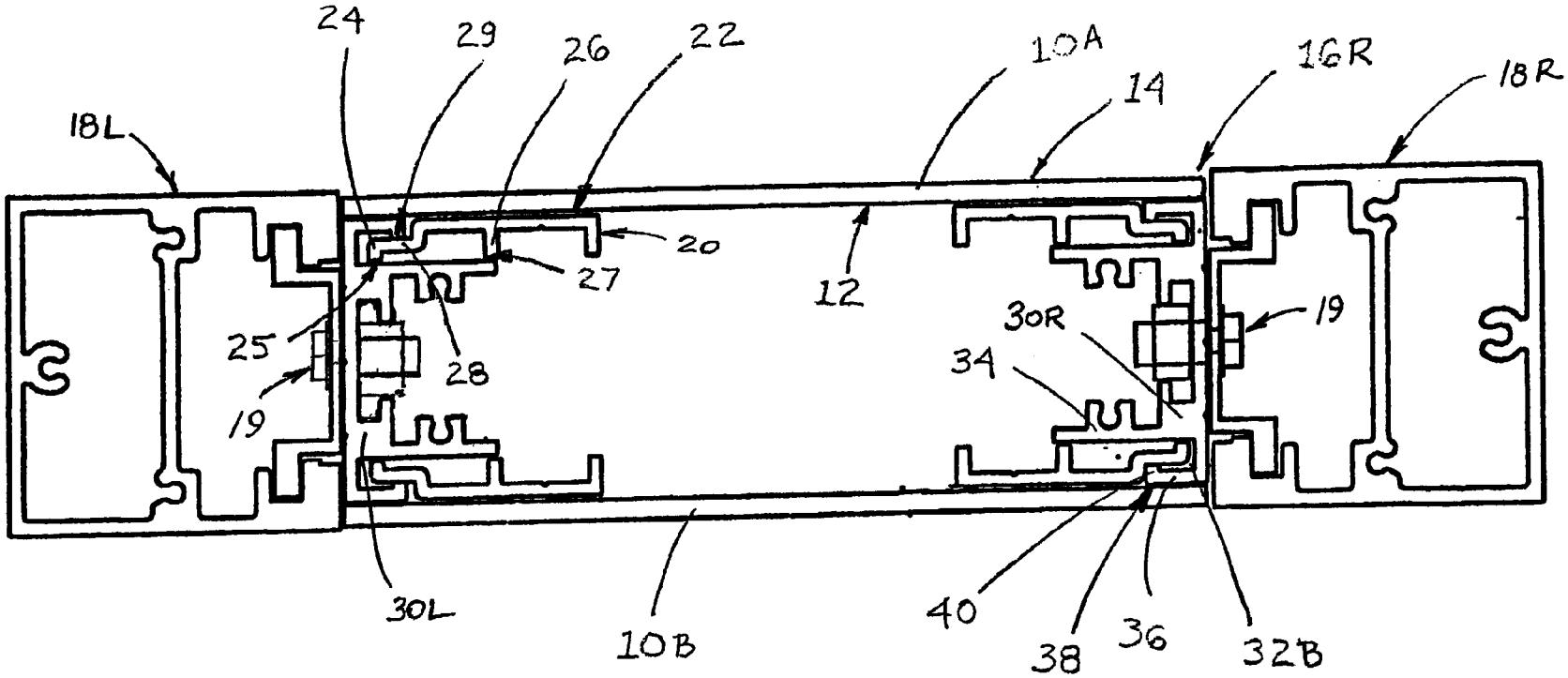
FIG. 2 is a top view of the preferred embodiment of the invention.
Figure 3:
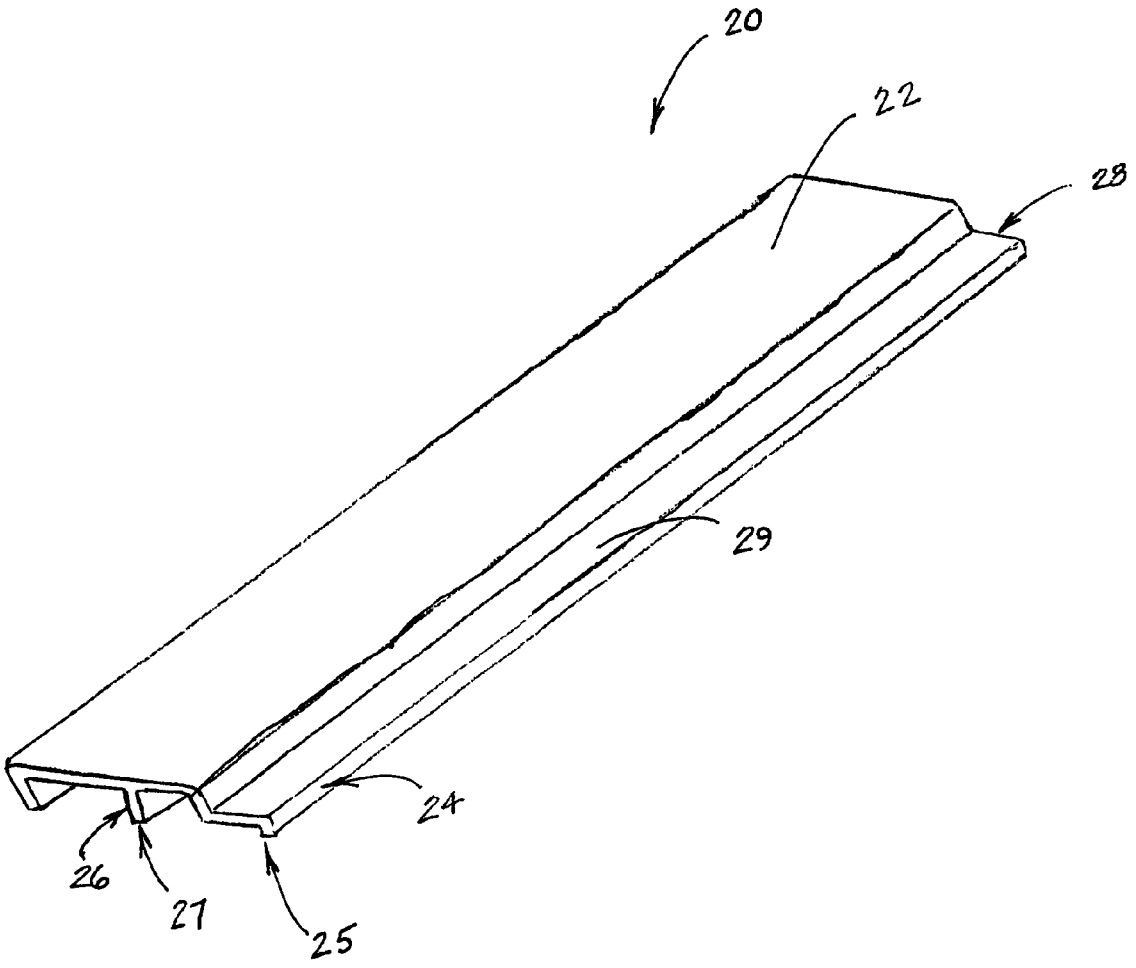
FIG. 3 is a perspective view of the mounting component of the preferred embodiment of the invention.
Figure 4:
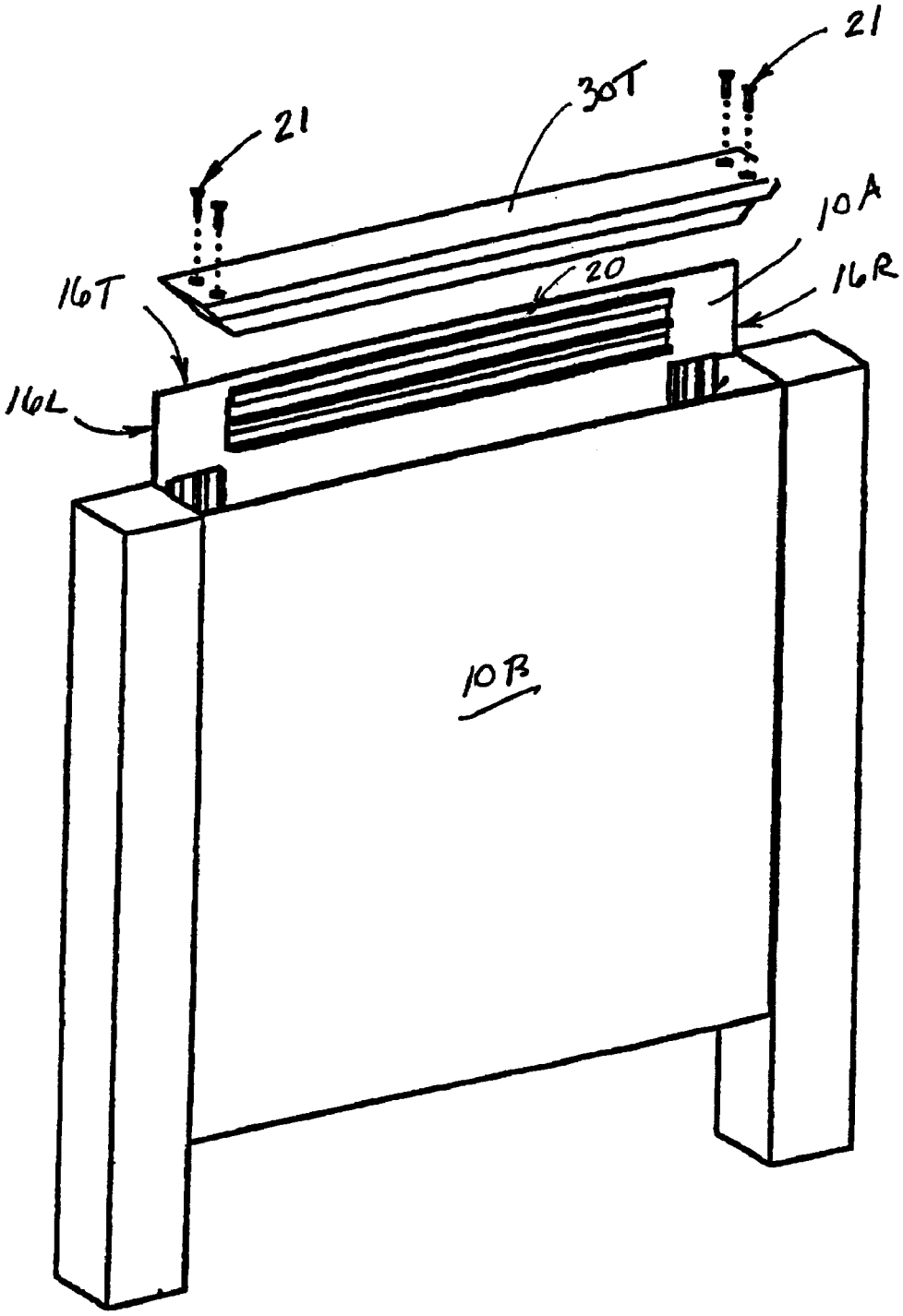
FIG. 4 is a plan view of the preferred embodiment of the invention.

The invention is illustrated by FIGS. 2, 3 and 4. As shown in FIG. 2, conventional sign frames 30L and 30R each include a pair of sign face channels 32A and 32B. Each of the sign face channels is adapted to receive a portion of a sign face adjacent to a peripheral side (as shown in FIG. 1). Furthermore, each sign face channel is defined by inner frame portion 34 and outer frame portion 36. Preferably, inner frame portion 34 is longer than outer frame portion 36, and the outer frame portion is provided with outer surface 38 and inwardly-turned outer frame portion 40. The sign frames are mounted on sign posts 18L and 18R by means of threaded fasteners 19. In the alternative, the sign frames may be mounted onto sign posts by welding or by other methods known to those having ordinary skill in the art to which the invention relates. The invention is also applicable to use with sign frames that are mounted onto walls or other surfaces.

Preferably, the sign assembly is comprised of four sign frames, including sign frames 30L, 30R, 30T (see FIG. 3) and a fourth sign frame (not shown) that is disposed opposite frame 30T. In this preferred embodiment of the invention, each of the sign frames is adapted to receive a portion of the sign face adjacent to a peripheral side. Thus, sign frame 30L is adapted to receive a portion of sign face 10A adjacent to peripheral side 16L and sign frame 30R is adapted to receive a portion of sign face 10A adjacent to peripheral side 16R. Sign frame 30T is adapted to receive a portion of sign face 10A adjacent to peripheral side 16T, and the fourth sign frame is adapted to receive a portion of sign face 10A adjacent to the side opposite 16T.

Sign face 10A has inner surface 12, outer surface 14 (which is opposite the inner surface), peripheral sides 16L, 16R, 16T (FIG. 3) and a fourth side (not shown) opposite side 16T. Sign faces 10A and 10B are adapted to be independently removably mounted on the sign frames. The sign faces may be made from any suitable material such as metal, plywood, plastic materials and the like. While FIGS. 2 and 3 illustrate the preferred embodiment of the invention having a pair of removably mounted sign faces 10A and 10B, it is also contemplated that the assembly may be provided with only one removably mounted sign face or with more than two independently removably mounted sign faces. It is also contemplated within the scope of the invention that the sign faces may be square, rectangular or any other shape adapted to be received into one or more sign frames. It is also contemplated that the sign faces may be generally planar as illustrated in the drawings or may be provided with any other suitable surface configuration such as a concave or convex surface.

The invention also includes a mounting component which includes a face support, an inner support and an outer support. The face support is adapted to be attached to the inner surface of the sign face adjacent to a peripheral side, while the inner support is adapted to bear against the inner frame portion of the sign frame and the outer support is adapted to bear against the outer frame portion of the sign frame. As shown in FIGS. 2 and 3, preferred mounting component 20 includes face support 22, first inner support 24 having first inwardly-turned edge portion 25, second inner support 26 having second inwardly-turned edge portion 27, and outer support 28 having outer planar region 29. Face support 22 is adapted to be attached to the inner surface of the sign face adjacent to a peripheral side, and edge portion 25 of first inner support 24 and edge portion 27 of second inner support 26 are adapted to bear against inner portion 34 of sign frame 30R. Outer support 28 of mounting component 20, which is preferably spaced laterally between first inner support 24 and second inner support 26, is adapted to bear against outer frame portion 36. Preferably, outer frame portion 36 of the sign frame includes inwardly-turned outer frame portion 40 against which outer planar region 29 of outer support 28 of the mounting component is adapted to bear. It is also preferred that face support 22 of mounting component 20 be generally planar, and generally coplanar with outer planar surface 38 of outer frame portion 36, so that outer planar surface 38 may bear against the inner surface of a sign face (such as surface 12 of sign face 10A).

Mounting components 20 may be made by any suitable means known to those having ordinary skill in the art to which the invention relates. In a preferred embodiment of the invention, mounting components 20 may be made of aluminum by an extrusion process. It is also contemplated that mounting components 20 may be made from plastic or any other suitable material. Mounting components 20 are preferably adhesively attached to the inner surface of a sign face by applying an adhesive to face support surface 22 (best shown in FIG. 3) or to the portion of the sign face which face support 22 is adapted to contact (or to both surfaces). In the alternative, the mounting components may be attached to the inner surface of the sign face by other known fastening means such as by use of threaded fasteners, rivets, welding and the like.

As shown in FIGS. 2 and 4, a mounting component is preferably provided for each frame channel and is attached to the inner surface of a sign face adjacent to a peripheral side so that a portion of each mounting component is received by the sign face channel. Furthermore, as described herein, the inner support (or preferably supports) of the mounting component will bear against the inner portion of the sign frame and the outer support of the mounting component will bear against the outer frame portion of the sign frame in order to removably secure the sign face within the assembly.

Sign frames 30 may be made of any convenient material by any suitable process. Preferably, the sign frames are made of aluminum by an extrusion process. It is also contemplated that sign frames 30 may be made from any other suitable material such as plastic materials. Individual sign frames may be attached together using any suitable conventional removable fastening devices such as threaded fasteners 21 (see FIG. 4). Sign frames 30 may be attached together in the shape of a square, a rectangle or any other shape permitting sign faces and mounting components to be received therein.

As shown in FIG. 4, a sign face such as sign face 10A may be removed from and replaced into the assembly by removing the fasteners attaching sign frame 30T to two other frames (not shown a in FIG. 3) such as frames 30L and 30R. After removing fasteners 21, sign frame 30T may be removed from the assembly, and sign face 10A may be slid out of the assembly. While FIG. 4 shows the removal of only one sign frame to remove the sign face, it is also contemplated that certain sign assembly configurations may require that more than one sign frame be removed in order to remove a sign face or faces.

When a user desires to replace a sign face (such as face 10A) into the assembly of the invention, the mounting components of the sign face are slidably received by the sign face channels of the sign frames in such manner that the inner support of each mounting component bears against the inner frame portion and the outer support of the mounting component bears against the outer frame portion. After the sign face is in position, the previously removed sign frame may be attached to the other sign frames using fasteners.

The invention claimed herein also includes a method for mounting a sign face, such as sign face 10A, having inner surface 12, outer surface 14 and a peripheral side, to a mounting component. A sign frame 30 having sign face channel 32 that is adapted to receive a portion of the sign face is provided. The sign face channel 32 is defined by inner frame portion 34 and outer frame portion 36, and in a preferred embodiment of the invention, outer frame portion 36 includes outer planar surface 38. Mounting component 20 is also provided The mounting component includes face support 22, which is preferably generally planar, an inner support that is adapted to bear against inner frame portion of sign frame 30, and outer support 28 that is adapted to bear against outer frame portion 36 of sign frame 30. According to this method, mounting component 20 is placed on sign frame 30 such that at least a portion of the mounting component is received by sign face channel 32, and so that the inner support of the mounting component bears against inner frame portion 34, and the outer support of the mounting component bears against outer frame portion 36. In a preferred embodiment of the invention, face support 22 is generally coplanar with outer planar surface 38 of outer frame portion 36 when outer support 28 bears against inwardly-turned outer frame portion 40, and first inwardly-turned edge portion 25 and second inwardly-turned edge portion 27 bear against inner frame portion 34. The sign face is then place on and attached to face support 22 of mounting component 20, preferably by means of an adhesive. It is also contemplated within the scope of the invention that the sign face may be attached to face support 22 by any suitable fastening device such as threaded fasteners, rivets and the like.

The invention claimed herein also includes a method for converting a conventional sign frame system such as is illustrated in FIG. 1 (having a framed appearance) into a sign system having a frameless appearance by employing a mounting component having a face support, an inner support that is adapted to bear against the inner frame portion of the sign frame and an outer support that is adapted to bear against the outer frame portion of the sign frame. Preferably, a component such as mounting component 20 having a generally planar face support 22, an inner support that is adapted to bear against inner frame portion 34 of the sign frame, and outer support 28 that is adapted to bear against outer frame portion 36 of the sign frame is provided. Face support 22 of mounting component 20 is attached to the inner surface of a sign face by adhesive or other means so that a portion of mounting component 20 may be received by sign face channel 32 of sign frame 30 in such manner that the inner support of the mounting component bears against inner frame portion 34 and outer support 28 bears against outer frame portion 36. Preferably, the face support of the mounting component is generally coplanar with the outer planar surface 38 of the outer frame portion of the sign frame.

The description of the invention demonstrates its numerous advantages. The use of the mounting components of the invention permit the mounting of a sign face to a sign assembly in such a way that the sign face is frameless-appearing. In addition, the sign face so mounted may be removed from and replaced into the sign assembly without removing and replacing the entire sign frame components. Similarly, because the individual sign faces are independent of each other, they may be independently removed from and replaced into the assembly. The simple design of the system makes manufacture and assembly of the invention less complicated than existing systems. Similarly, the removal and replacement of the sign faces of the invention is easier and less time consuming than in existing frameless-appearing sign systems. Finally, the invention is adapted to permit the conversion of a conventional sign face assembly having channel frames into a removable sign face having a frameless appearance.

Although this description contains many specifics these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A sign assembly which comprises:

(a) a sign face having:

(i) an outer surface;

(ii) an inner surface;
(iii) a peripheral side;

(b) a sign frame including a sign face channel that is:
(i) defined by an inner frame portion and an outer frame portion;
(ii) adapted to receive a portion of the sign face adjacent to the peripheral side;

(c) a mounting component having:
(i) a face support that is attached to the inner surface of the sign face adjacent to the peripheral side of such face;
(ii) an inner support that is adapted to bear against the inner frame portion;
(iii) an outer support that is adapted to bear against the outer frame portion.

2. The assembly of claim 1, wherein the sign frame includes a pair of sign face channels which are spaced to support a pair of sign faces in a generally parallel relationship.

3. The assembly of claim 1, wherein the mounting component includes a first inner support and a second inner support, and wherein each of the inner supports is adapted to bear against the inner frame portion of the sign frame.

4. The assembly of claim 3, wherein the inner frame portion of the sign frame is longer than the outer frame portion.

5. The assembly of claim 4, wherein the outer support of the mounting component is spaced laterally between the first inner support and the second inner support.

6. The assembly of claim 1, wherein the outer frame portion of the sign frame includes an inwardly-tuned outer frame portion against which the outer support of the mounting component is adapted to bear.

7. The assembly of claim 6, wherein the outer support of the mounting component includes an outer planar region that is adapted to bear against the inwardly-turned outer frame portion of the outer frame portion of the sign frame.

8. The assembly of claim 1, wherein the inner support of the mounting component includes an inwardly-turned edge portion which bears against the inner frame portion.

9. The assembly of claim 1, wherein the mounting component includes a first inner support and a second inner support, and wherein each of the inner supports includes an inwardly-turned edge portion that is adapted to bear against the inner frame portion of the sign frame.

10. The assembly of claim 9, wherein the inner frame portion of the sign frame is longer than the outer frame portion.

11. The assembly of claim 10, wherein the outer support of the mounting component is spaced laterally between the first inner support and the second inner support.

12. A sign assembly which comprises:

(a) a generally rectangular sign face having an outer surface, an inner surface and four peripheral sides;

(b) a pair of sign frames, each of which includes a sign face channel that is:
(i) defined by an inner frame portion and an outer frame portion, with said inner frame portion being longer than the outer frame portion, and said outer frame portion having an outer planar surface and including an inwardly-turned outer frame portion;
(ii) adapted to receive a portion of the sign face adjacent to a peripheral side;

wherein said sign frames are arranged so that said sign face channels are adapted to receive portions of opposite peripheral sides of the sign face;

(c) a pair of mounting components, each of which has:
(i) a face support that is attached to the inner surface of the sign face adjacent to a peripheral side of such face;
(ii) a first inner support that is adapted to bear against the inner frame portion;
(iii) a second inner support that is adapted to bear against the inner frame portion;
(iv) an outer support having an outer planar region that is adapted to bear against the outer frame portion, which outer planar region is spaced laterally between the first inner support and the second inner support;

wherein the face support of each of the mounting components is generally coplanar with the outer planar surface of the outer frame portion of the sign frame with which it is associated.

13. The assembly of claim 12 which includes:

(b) four sign frames, one for each peripheral side of the sign face, each of which such frames includes a sign face channel that is:
(i) defined by an inner frame portion and an outer frame portion, with said inner frame portion being longer than the outer frame portion, and said outer frame portion having an outer planar surface and including an inwardly-turned outer frame portion;
(ii) adapted to receive a portion of the sign face adjacent to a peripheral side;

(c) four mounting components, each of which has:
(i) a face support that is attached to the inner surface of the sign face adjacent to a peripheral side of such face;
(ii) a first inner support that is adapted to bear against the inner frame portion;
(iii) a second inner support that is adapted to bear against the inner frame portion;
(iv) an outer support having an outer planar region that is adapted to bear against the outer frame portion, which outer planar region is spaced laterally between the first inner support and the second inner support;

wherein the face support of each of the mounting components is generally coplanar with the outer planar surface of the outer frame portion of the sign frame with which it is associated.

14. A method for mounting a sign face onto a frame assembly which includes a sign frame including a sign face channel that is defined by an inner frame portion and an outer frame portion, said channel being adapted to receive a portion of the sign face, said method comprising (a) providing a mounting component having:
(i) a face support;
(ii) an inner support that is adapted to bear against the inner frame portion;
(ii) an outer support that is adapted to bear against the outer frame portion;

(b) placing the mounting component on the frame assembly so that said inner support bears against the inner frame portion and the outer support bears against the outer frame portion when at least a portion of the mounting component is received by the sign face channel;

(c) attaching the sign face to the mounting component.

15. The method of claim 14 which includes providing a mounting component having a face support that is generally coplanar with the outer frame portion of the sign frame when the inner support of the mounting component bears against the inner frame portion of the sign frame and the outer support of the mounting component bears against the outer frame portion of the sign frame.

16. The method of claim 14 wherein said sign face is adhesively attached to the face support of the mounting component.

17. A method for converting a mounting system for a sign face from a framed assembly to a frameless-appearing assembly, wherein said system includes a sign frame having a sign face channel that is adapted to receive a portion of the sign face, said sign face channel being defined by an inner frame portion and an outer frame portion, said method comprising:

(a) providing a mounting component having:
  (i) a face support;
  (ii) an inner support that is adapted to bear against the inner frame portion;
  (iii) an outer support that is adapted to bear against the outer frame portion;

(b) attaching the mounting component to an inner surface of the sign face so that at least a portion of the mounting component may be received by the sign face channel;

(c) inserting the mounting component into the sign face channel so that the inner frame support bears against the inner frame portion and the outer frame support bears against the inside surface of the outer frame portion of the sign frame while at least a portion of the inner surface of the sign face bears against a portion of the outside surface of the outer frame portion.

18. A mounting component for use in converting a mounting system for a sign face from a framed assembly to a frameless-appearing assembly, wherein said system includes a sign frame having a sign face channel that is adapted to receive a portion of the sign face, said sign face channel being defined by an inner frame portion and an outer frame portion, said mounting component having:

(a) a face support that may be attached to an inner surface of the sign face;

(b) an inner support that is adapted to bear against the inner frame portion when the sign face is attached to the face support;

(c) an outer support that is adapted to bear against the outer frame portion when the sign face is attached to the face support.

* * * * *